US012606353B2

(12) United States Patent
Bongiardino

(10) Patent No.: US 12,606,353 B2
(45) Date of Patent: Apr. 21, 2026

(54) SOUVENIR AND MEMENTO APPARATUS

(71) Applicant: Peter Bongiardino, Hewitt, NJ (US)

(72) Inventor: Peter Bongiardino, Hewitt, NJ (US)

(73) Assignee: Peter Bongiardino, Hewitt, NJ (US)

( * ) Notice: Subject to any disclaimer, the term of this patent is extended or adjusted under 35 U.S.C. 154(b) by 0 days.

(21) Appl. No.: 18/340,534

(22) Filed: Jun. 23, 2023

(65) Prior Publication Data

US 2024/0425246 A1 Dec. 26, 2024

(51) Int. Cl.
*B65D 47/02* (2006.01)
*B65D 41/20* (2006.01)

(52) U.S. Cl.
CPC ..... *B65D 47/02* (2013.01); *B65D 41/20* (2013.01)

(58) Field of Classification Search
CPC ..... B65D 51/2835; B65D 47/02; B65D 41/20
See application file for complete search history.

(56) References Cited

U.S. PATENT DOCUMENTS 4,546,659 A * 10/1985 Gill ..... G01N 1/24 73/864.62
4,925,470 A 5/1990 Chou
5,499,735 A 3/1996 Chen
5,522,155 A * 6/1996 Jones ..... A61J 1/065 34/286
2008/0121050 A1* 5/2008 Sakal ..... B01L 3/50825 73/864.91
2015/0175337 A1* 6/2015 Lee ..... B65D 81/3211 206/219
2015/0375899 A1* 12/2015 Bongiardino ..... A44C 25/004 206/524.8
2020/0046609 A1 2/2020 Keadle
2023/0277415 A1* 9/2023 Bucholtz ..... A61J 1/05 604/403
2023/0314293 A1* 10/2023 Jordan ..... B01L 3/5023 422/535

FOREIGN PATENT DOCUMENTS

CN 2612384 Y 4/2004
DE 102005017985 A1 10/2006
WO 02087988 A2 11/2002

* cited by examiner

*Primary Examiner* — Shawn M Braden
(74) *Attorney, Agent, or Firm* — Rosenthal IP Law; Lawrence Rosenthal

(57) ABSTRACT

A souvenir apparatus is provided for capturing and retaining air from a particular location. The apparatus includes a vessel containing a vacuum and an activating arrangement configured to allow air to be sucked into the vessel from the location where the device is activated. The activating arrangement can be provided with audible and/or visible indicators to show that the apparatus has been activated. A cover can optionally be affixed to the top of the apparatus as a decorative feature and/or to provide an air-tight seal after activation. Adhesive labels and/or writeable surfaces can be provided on the apparatus to indicate the location, date, and/or other information pertaining to where/when the apparatus was activated.

7 Claims, 2 Drawing Sheets

SOUVENIR AND MEMENTO APPARATUS

BACKGROUND INFORMATION

Souvenirs are very popular and represent a significant amount of business at tourist destinations and in similar areas. Souvenirs can be almost any decorative object and may have the appearance or other characteristics of the location, such as miniature reproductions of famous buildings, bridges, or the like. Many souvenirs are more generic items that can be decorated with the location name or the name of a tourist attraction, often with appropriate images provided on the object. Examples of such souvenirs are shot glasses, bottle openers, hat pins, and the like. Many people who like to travel collect certain types of such souvenirs from different locations they have visited. However, such typical souvenirs tend to be mass-produced and are somewhat impersonal.

Other types of souvenirs include objects or material that is obtained at a visited location. These souvenirs can include things like beach sand or seashells, a piece of stone from a building or monument, pine cones from a forest, etc. However, many locations forbid or discourage the taking of such physical objects, as they may lead to deterioration of the location from which they were removed or other undesirable effects. Further, such unique and more personal souvenirs often aren't identified with a particular location, being 'found' objects, and must be labeled or identified in some manner so that their source will not be forgotten in later years.

Accordingly, there may be a need for an apparatus that can provide personal, collectible souvenirs that serve as a memento of a given location, and that can address and/or overcome at least some of the deficiencies or issues described herein above.

SUMMARY OF THE DISCLOSURE

Embodiments of the disclosure provide a device or apparatus for capturing a memento or souvenir of a location. The device includes a vessel containing a vacuum (e.g., some air at a pressure below atmospheric pressure) and a valve arrangement configured to break a seal on the vessel to then suck in air from the location where the device is activated. The vessel can be made of a rigid material such as glass or plastic to maintain its shape against the internal vacuum, where pressure within the vessel is preferably about 5-10 psi (pounds per square inch), to allow air at ambient surrounding pressures to be pulled into the vessel when the device is activated.

The valve arrangement can have any one of several forms, including a tube that pierces an inner membrane when pressed downward to allow air to enter, a spring-loaded valve that also allows air to enter the interior when pressed down, a screw-on cap that either presses a tube downward to pierce a membrane or opens a valve to allow air in when screwed downward, etc. A simple one-way valve can be provided in certain configurations to seal the vessel after air has been sucked into it. In further embodiments, the activating button or top can be configured to be affixed to the vessel after it has been activated to provide an air-tight seal.

Audible and/or visible indicators can optionally be provided to show that the apparatus has been activated. Such indicators can include, e.g., a whistle or a vibrating reed arrangement that produces a sound when air rushes into the vessel, a colored powder or gas that can be sucked into the vessel along with the incoming air, a small flap configured to move to a different position when the vacuum inside the vessel is released, etc. In some embodiments, the activating mechanism can be configured to lock into place (e.g. a top button can lock in a downward position when pressed), thereby also indicating that the device has been activated.

In still further embodiments, a cover can be provided that can be affixed to the top of the device and conceal at least part of the activating mechanism. This cover can be decorative, e.g., it may be shaped and/or printed on to indicate the location where the device will be used. This cover can also be configured to provide an air-tight seal when affixed to the top of the souvenir apparatus.

Adhesive labels and/or writeable surfaces can be provided on the apparatus, and can allow a user to indicate the location, date, and/or other information pertaining to where and when the apparatus was activated and where/when the enclosed air was obtained from.

BRIEF DESCRIPTION OF THE DRAWINGS

Further objects, features and advantages of the disclosure will become apparent from the following detailed description taken in conjunction with the accompanying figures showing illustrative examples, results and/or features of the exemplary embodiments of the present disclosure, in which.

The various embodiments of the disclosure are described herein with reference to the figures, where like reference numbers indicate identical or functionally similar elements. Further features and advantages of the disclosure as well as the structure and operation of various embodiments of the present disclosure are described in detail below with reference to the accompanying drawings. To the extent that the present disclosure does reference the figures, it is done so in connection with the illustrative embodiments and is not limited by the particular embodiments illustrated in the figures. It is intended that changes and modifications can be made to the described embodiments without departing from the true scope and spirit of the present disclosure.

DETAILED DESCRIPTION OF EXEMPLARY EMBODIMENTS

Embodiments of the disclosure provide a device for capturing a memento or souvenir of a location. The device includes a vessel containing a vacuum (e.g., some air at a pressure below atmospheric pressure) and a valve arrangement configured to break a seal on the vessel to then suck in air from the location where the valve was activated, thereby capturing air from the location inside the vessel. The device can further include one or more arrangements to indicate that the device has been activated and thus is full of captured air, and various options for identifying where the air was captured from.

Figure 1:
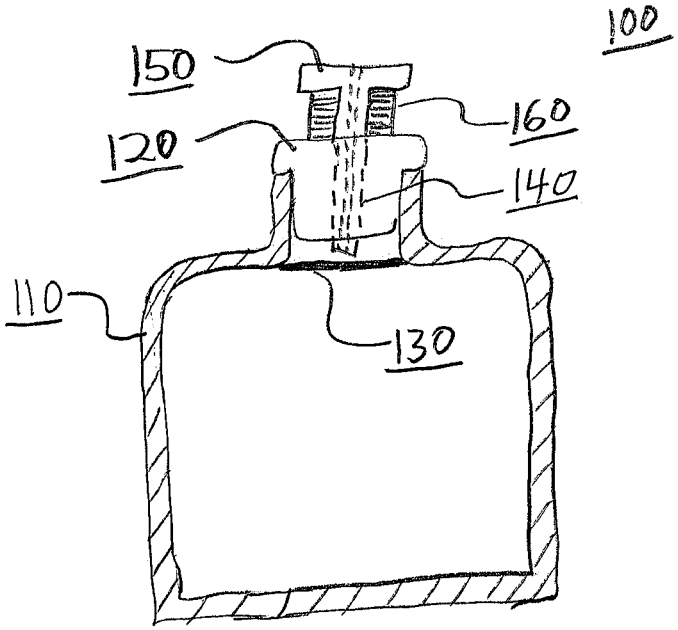
FIG. 1 illustrates a souvenir apparatus for capturing and retaining air at a location according to exemplary embodiments of the disclosure.

An exemplary souvenir apparatus 100 according to some embodiments of the disclosure is illustrated in FIG. 1. The apparatus 100 includes a vessel 110, with a cap 120 provided in the opening thereof. A hollow tube (or needle) 140 can be provided that extends through a passage in the cap 120 and is slidably engaged with the cap 120 such that it can move upward and downward relative to the cap 120. An air-tight diaphragm 130 (or similar barrier) can be provided across a lower surface of the cap 120 surrounding the tube 140, e.g., below the lower end of the tube 140. This diaphragm can seal the lower end of the opening in the cap 120 containing the tube 140, and can be rigid enough to maintain a vacuum or reduced pressure within the vessel 110 prior to it being activated. The upper portion of the tube 140 can be formed as a button 150 that extends above the cap 120, or alternatively the button 150 can be affixed to the upper portion of the tube 140. An optional removable spacer 160 can be provided between the button 150 and the cap 120 to prevent the button 150 from being pushed down inadvertently or accidentally. The spacer 160 can be removable, e.g., snapped off or peeled away, to allow the button 150 to be pushed down when activation of the apparatus 100 is desired.

During use of the device, the button 150 can be pressed downward, forcing the tube 140 through the diaphragm 130. A hole or passage can be provided through the button 150 that is connected to the tube 140, or optionally the button 150 and tube 140 can be formed as a single component. The tube 140 can pierce a hole through the diaphragm 130, allowing outside air to be pulled into the vessel 110 through the tube 140. For example, the lower end of the tube 140 can have a sharp point or angled profile to facilitate piercing of the membrane 130. In this manner, local air is captured inside the vessel 110, and the apparatus 100 containing captured air from a location can be kept or gifted by a user as a memento of the location where the air was captured. Further features and alternative mechanisms that may be used with the apparatus 100 are described in more detail below.

The vessel 110 can be provided in any size appropriate for a memento. For example, it can be relatively small, e.g., about the size of a spice jar or smaller, to enhance portability of the memento. Alternatively, it can be somewhat larger, e.g., about the size of a snow globe or similar container, to produce a larger souvenir that can hold more captured air from the location. Larger vessel sizes can be used in further embodiments, and any vessel size that is employed is preferably sized appropriately such that it can be easily carried and used as a souvenir.

The vessel 110 can be made from a variety of materials, including glass, plastic, and the like. In some embodiments, the vessel 110 can have a decorative shape, e.g., a shape corresponding to a particular location or type of location, or to a particular landmark where the souvenir apparatus 100 may be sold and used. Examples of such shapes include, but are not limited to, a building or monument, a bridge, a boat or ship, etc. In some embodiments, the vessel 110 can be decorated (e.g. painted) or formed using multiple materials to provide a more detailed representation of a location or landmark. The vessel 110 should be made from a nonporous material that can retain a vacuum and be rigid enough to prevent collapsing or implosion when there is a reduced pressure inside, e.g., prior to activating the apparatus 100.

The pressure inside the vessel 110 should initially be sufficiently low such that it can draw air into the vessel when the activating mechanism (e.g. the cap 120, diaphragm 130, tube 140, and button 150) is employed to break the vacuum seal (e.g. the diaphragm 130). For example, standard atmospheric pressure is about 14.7 psi (pounds per square inch). Ambient air pressure tends to decrease with increasing altitude, with temperature and weather conditions having relatively minor effects. For use at most elevations close to sea level, an internal pressure of the sealed vessel can be about 5-10 psi. Lower internal pressures (e.g. greater degrees of vacuum) can be used, but such lower pressures may require a sturdier vessel 110 and/or a sturdier membrane 130 to reliably contain the vacuum.

At higher altitudes, lower internal vessel pressures may be desirable. For example, some ski resorts are located at elevations of about 9,000-13,000 feet above sea level. At 13,000 feet elevation, the local air pressure is about 9 psi. Accordingly, for an apparatus 100 to be used at a high-elevation site, the internal vessel pressure should preferably be close to about 5 psi. This will ensure that some local air is drawn into the vessel 110 at such higher altitudes.

In some embodiments, an indicator arrangement can be provided with the apparatus 100 that generates a visual and/or audible effect to show that the apparatus 100 has been activated and has drawn local air into the vessel 110. In one embodiment, a vibrating flap or an orifice can be provided within or adjacent to the tube 140, diaphragm 130, and/or button 150. Such flap or orifice can be configured such that it produces an audible sound when the apparatus 100 is activated and air rushes into the vessel 110 through the tube 140. Many devices that produced sound from moving air are known in the art, and one or more of such devices can be sized and placed appropriately on or within the apparatus 100 to generate an audible sound when the internal vacuum is released and local air is sucked into the vessel 110.

In further embodiments, the apparatus 100 can be provided with a visible indicator to show when the apparatus 100 has been activated and filled with local air. In one embodiment, a small amount of colored powder or liquid can be provided in a reservoir (not illustrated) below or adjacent to the tube 140 and above the diaphragm 130. When the apparatus 100 is activated, the intake of local air can propel or pull the colored material into the vessel 110, thereby changing the internal appearance of the vessel 110 after the vacuum has been released.

In another embodiment (not illustrated), a colored flap or sheet of material can be provided near the opening of the vessel 110, and configured such that when the local air is drawn into the vessel 110 and the vacuum released, the flap moves slightly into a position where it can be seen. This can provide a visual indicator that the apparatus 100 has been activated.

In a further embodiment, the apparatus 100 can be configured such that button 150 remains pressed down against the cap 120 after it is pushed down to activate the apparatus 100 and draw local air into the vessel 110. This can be achieved, e.g., by a simple frictional fit between the tube 140 and the passage inside the cap 140 that it passes through. Accordingly, when the button 150 in the raised position it can indicate that the apparatus 100 has not been activated yet, and when it is in a pressed down position (e.g. button 150 rests against the top of the cap 120) it can show that the device 100 has been activated. Any of the audible and visible indicators can be used, individually or in combination, with any of the activating arrangements and other embodiments described herein.

Figure 2:
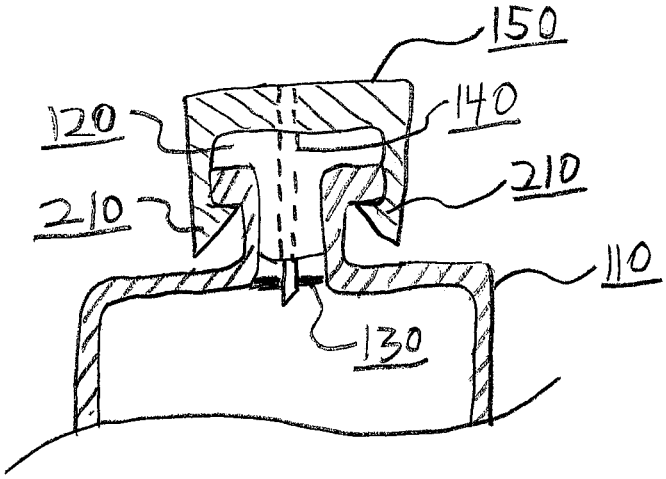
FIG. 2 illustrates an alternative activating arrangement configured to lock a top button onto the top of the apparatus when it is activated.

In some embodiments, a simple mechanical protrusion or one-way flap can be provided on the button 150, tube 140, and/or cap 120 that can prevent the button 150 from being lifted after it has been pressed down. This can improve the reliability of this visible usage indicator, and prevent the appearance of an unactivated apparatus 100 after the button 150 has been pushed down. For example, a ratcheting surface similar to that used on common zip ties or cable ties can be provided on the button 150, tube 140, and/or interior of the cap 120 that allows the button 150 to be pushed downward, but resists or prevents upward motion of the tube 140 and button 150 after the button 150 has been pressed down. In another embodiment, illustrated in FIG. 2, one or more locking clasps 210 (e.g., angled plastic tabs or the like) can be provided that lock the button 150 against the surface of the cap 120 when the button 150 is pressed downward against the top surface of the cap 120. For example, one or more tabs 210 on the button 150 can be configured to interlock with corresponding recesses on the cap 120 or upper portion of the vessel 110 when the button 150 is in a lowered position. FIG. 2 also illustrates the tube 140 after the button 150 has been pressed down and the tube 140 has pierced the diaphragm 130, thereby allowing air to enter the vessel 110.

Figure 3:
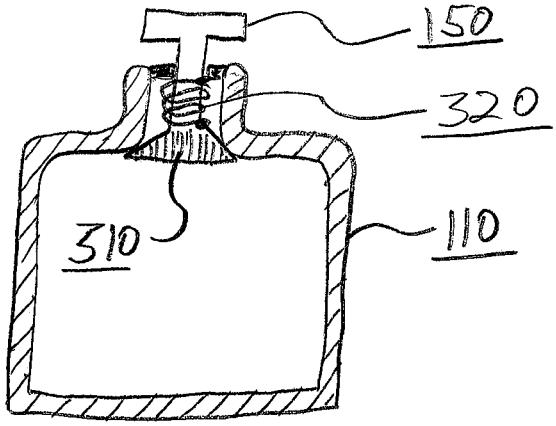
FIG. 3 illustrates a further activating arrangement for the apparatus that includes a spring-loaded valve.

In a further embodiment, shown in FIG. 3, the activating arrangement can include a valve 310 that seals an opening within the upper portion of the vessel 100. The valve 310 can be held upward against the pull of the vacuum within the vessel 110 by a spring 320 or similar retaining member. When the button 150 is pressed downward, the valve 310 allows local air to be sucked into the vessel 110. After being activated, the spring 320 pushes the valve 310 upward to reseal the vessel 110.

In any of the embodiments described herein, a simple one-way valve (e.g., a flap covering one side of an opening in the tube 140 or other passage through which air can enter the vessel 110, not illustrated) can be provided to seal the interior of the vessel 110 after the apparatus 100 has been activated, thereby preventing subsequent escape or leakage of the trapped air from inside the vessel 110. In another embodiment, the membrane 130 can be self-sealing, such that it reseals after the tube 140 is withdrawn from it. Because the interior and exterior pressures of the vessel 110 are substantially the same after the apparatus 100 has been activated, such a membrane 130 can effectively retain the captured local air within the vessel 110.

Figure 4:
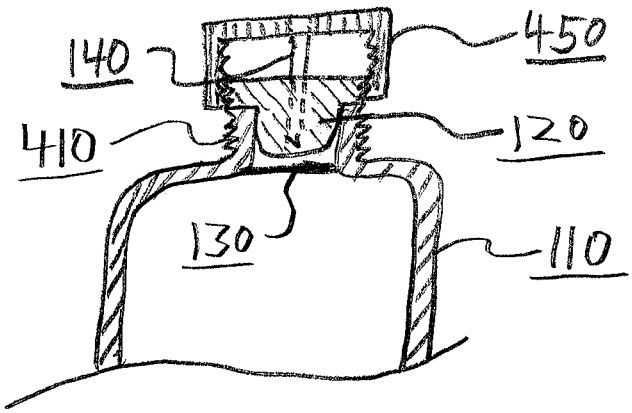
FIG. 4 illustrates a still further activating arrangement for the apparatus that includes a screw top configured to pierce a membrane with a tube when it is screwed down.

In a still further embodiment, illustrated in FIG. 4, the button 450 can have the form of a screw-on cap that engages with threads 410 on the outer surface of the cap 120 and/or upper portion of the vessel 110. To activate the apparatus 100 with this embodiment, the button 450 can be rotated and screwed onto the vessel 110 such that it pushes the tube 140 downward to pierce the membrane 130. Alternatively, such a screw-on button 450 can be used with the valve arrangement shown in FIG. 3 to push the valve 310 downward to allow air to enter the vessel 110. The screw-on button 450 can also be configured to then seal the vessel 110 when it is fully screwed down.

In still further embodiments, any of the various souvenir devices described herein can be provided with a cover configured to be affixed to the upper portion of the cap 120 or vessel 110 after the apparatus 100 has been activated, thereby covering the activating arrangement fully or partially. This cover can be configured to attach to the apparatus 100 in any of a variety of ways, including snapping onto the top (e.g., using clasps similar to the clasps 210 illustrated in FIG. 2), screwing onto the top of the apparatus 100, providing a frictional fit when pressed onto the top of the apparatus 100, etc. The cover can also provide an air-tight seal after the apparatus 100 has been activated, and can optionally have a decorative form.

In some embodiments, custom decorative covers may be provided for a standard or generic souvenir apparatus 100, where such custom covers may be shaped, decorated, and/or labeled to indicate a local tourist attraction, monument, or other identifying features pertinent to where the apparatus 100 will be used. In this manner, the apparatus 100 can provide an indication of where the local air was captured when it is taken home, gifted, etc. away from the activation location.

In some embodiments, the apparatus 100 can be provided with a portion of the surface that is configured to be written on (e.g., with a pen or marker) such that a user can label the apparatus 100 with the location and/or date, or other identifying information, indicating where the apparatus 100 was activated. Adhesive labels can also be provided to facilitate such identification, where such labels may be pre-printed or also designed to be written on by a user.

In further embodiments, various features described herein can be combined in a single apparatus to achieve their individual functions in a single apparatus. For example, an audible indicator, in which a noise is generated when air is sucked into the vessel 100, can be used with the diaphragm 130 and tube 140 arrangements that are configured to allow air to enter the vessel 110, as illustrated in FIGS. 1, 2, and 4. Similarly, such an audible indicator can be used with the valve arrangement 310 shown in FIG. 3.

In still further embodiments, any of the visual indicators described herein (e.g., a colored powder or liquid, or a colored flap, as described herein) can be used with any of the embodiments illustrated in FIGS. 1-4 that show different exemplary mechanisms for allowing air to enter the vessel 110 that is initially at a pressure that is below atmospheric pressure.

In yet further embodiments, both an audible indicator as well as a visual indicator (e.g., a colored powder or liquid, or a colored flap) can be used with any of the embodiments illustrated in FIGS. 1-4 that show different exemplary mechanisms (e.g., a tube 140 piercing a diaphragm 130, or a valve arrangement 310) for allowing local air to enter the vessel 110 upon activating such mechanisms.

The foregoing merely illustrates the principles of the exemplary embodiments of the present disclosure. Other variations to the exemplary embodiments can be understood and effected by those skilled in the art in practising the claimed invention from a study of the drawings, the disclosure, and the appended paragraphs. The mere fact that certain features are described in different paragraphs and/or illustrated in different figures does not indicate that any combination of these features cannot be used advantageously. Various modifications and alterations to the described exemplary embodiments will be apparent to those skilled in the art in view of the teachings herein. It will thus be appreciated that those skilled in the art will be able to devise numerous techniques which, although not explicitly described herein, embody the principles of the invention and are thus within the spirit and scope of the present disclosure.

What is claimed is:

1. An apparatus for collecting air at a location, comprising:

a vessel containing a reduced pressure therein;

an activating mechanism configured to allow air to enter the vessel and then seal the vessel to retain the air, wherein the activating mechanism is configured as a single-use mechanism that retains the entered air within the vessel indefinitely after a single activation thereof, and wherein the activating mechanism comprises a hollow tube configured to pierce a membrane separating an interior of the vessel from its surroundings; and a button coupled to the tube, wherein the button is configured to push the tube through the membrane when it is pressed down, and wherein the button is configured to remain affixed to the vessel in a pressed down position after the membrane is pierced.

2. The apparatus of claim 1, wherein the activating mechanism comprises a valve configured to allow the air to enter the vessel when it is pressed downward.

3. An apparatus for collecting air at a location, comprising:

a vessel containing a reduced pressure therein; and an activating mechanism configured to allow air to enter the vessel and then seal the vessel to retain the air, wherein the activating mechanism is configured as a single-use mechanism that retains the entered air within the vessel indefinitely after a single activation thereof; and an audible indicator configured to produce a sound when the air enters the vessel, wherein the audible indicator comprises at least one of a whistle or a vibrating reed.

4. The apparatus of claim 1, further comprising a visible indicator configured to provide a visual indication after the air enters the vessel.

5. The apparatus of claim 4, wherein the visible indicator comprises at least one of a colored powder or a colored gas that is configured to be drawn into the vessel together with the entering air.

6. The apparatus of claim 1, further comprising an identification arrangement configured to facilitate identification of at least one of where and when the air entered the vessel.

7. The apparatus of claim 6, wherein the identification arrangement comprises at least one of a writeable surface, a design provided on the vessel, wording provided on the vessel, and a cap configured to be placed atop the vessel, wherein the cap further comprises identifying elements.

* * * * *